US006018897A

United States Patent [19]

Lin

[11] Patent Number: 6,018,897

[45] Date of Patent: Feb. 1, 2000

[54] MINI ELECTRIC IRON WITH CERAMIC HEATER

[76] Inventor: Chun-Liang Lin, P.O. Box 82-144, Taipei, Taiwan

[21] Appl. No.: 09/161,661

[22] Filed: Sep. 29, 1998

[51] Int. Cl.[7] ..... D06F 75/24; D06F 75/28

[52] U.S. Cl. ..... 38/82; 38/88

[58] Field of Search ..... 38/74, 77.7, 82, 38/83, 88, 89; 219/245, 250, 254, 258, 256

[56] References Cited

U.S. PATENT DOCUMENTS

| | | | |
|---|---|---|---|
| 1,685,030 | 9/1928 | Lavoie | 38/82 |
| 2,701,293 | 2/1955 | Russell | 38/82 |
| 4,233,763 | 11/1980 | McMullen | 38/93 X |
| 4,523,079 | 6/1985 | Albinger, Jr. | 38/82 X |
| 4,716,276 | 12/1987 | Motegi et al. | 38/82 X |
| 4,835,363 | 5/1989 | Hoffmann | 38/82 X |

FOREIGN PATENT DOCUMENTS

| | | | |
|---|---|---|---|
| 4005997 | 1/1992 | Japan | 38/89 |

*Primary Examiner*—Ismael Izaguirre
*Attorney, Agent, or Firm*—A & J

[57] ABSTRACT

A mini electric iron includes a housing made of non-metallic material and having a lower portion provided with a receptacle and two openings, a metal base having a flat bottom, a T-shaped mounting having three depending legs secured to an upper side of the metal base thus forming a space between the T-shaped mounting and the metal base the T-shaped mounting being provided with a lug at an entrance of the space, the T-shaped mounting being formed with three threaded holes, a sleeve fitted inside the space, a ceramic heating member fitted inside the sleeve and electrically connected with the receptacle, the ceramic heating member being provided with a sheet of metal at a top and bottom thereof and inserted within an insulating high temperature resistant enclosure, a first screw extending through one of the threaded holes to bear against a top of the sleeve, two second screws extending the two openings and other two of the threaded holes to bear against the top of the sleeve, and a detachable electrical connector engageable with the socket, whereby the mini electric iron can be rapidly assembled and is easy to use.

1 Claim, 4 Drawing Sheets

MINI ELECTRIC IRON WITH CERAMIC HEATER

BACKGROUND OF THE INVENTION

1. Field of the Invention

This invention is related to a mini electric iron and in particular to one with improvement in the structure.

2. Description of the Prior Art

It has been found that mini irons have been in use for a considerable period of time and are characterized by their portability. Such irons are designed to be light in weight and compact in size. However, known mini irons have had to compromise versatility and performance to obtain their necessary light weight and compact size. The compact design of mini irons has presented problems in maintaining uniform heating of the soleplate of the iron while limiting the amount of heat transmitted to the handle and the housing. Known mini irons have required a complex arrangement of parts to be lightweight and small in size, resulting in a costly and unattractive product.

Therefore, it is an object of the present invention to provide an improved mini electric iron which can obviate and mitigate the above-mentioned drawbacks.

SUMMARY OF THE INVENTION

This invention is related to an improved mini electric iron.

According a preferred embodiment of the present invention, a mini electric iron includes a housing made of non-metallic material and having a lower portion provided with a receptacle and two openings, a metal base having a flat bottom, a T-shaped mounting having three depending legs secured to an upper side of the metal base thus forming a space between the T-shaped mounting and the metal base the T-shaped mounting being provided with a lug at an entrance of the space, the T-shaped mounting being formed with three threaded holes, a sleeve fitted inside the space, a ceramic heating member fitted inside the sleeve and electrically connected with the receptacle, the ceramic heating member being provided with a sheet of metal at a top and bottom thereof and inserted within an insulating high temperature resistant enclosure, a first screw extending through one of the threaded holes to bear against a top of the sleeve, two second screws extending the two openings and other two of the threaded holes to bear against the top of the sleeve, and a detachable electrical connector engageable with the socket.

It is the primary object of the present invention to provide a mini electric iron which can be rapidly assembled.

It is another object of the present invention to provide a mini electric iron which is easy to use.

It is still another object of the present invention to provide a mini electric iron which is convenient to carry.

It is still another object of the present invention to provide a mini electric iron which is facile to stow when not in use.

It is a further object of the present invention to provide a mini electric iron which is low in cost.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
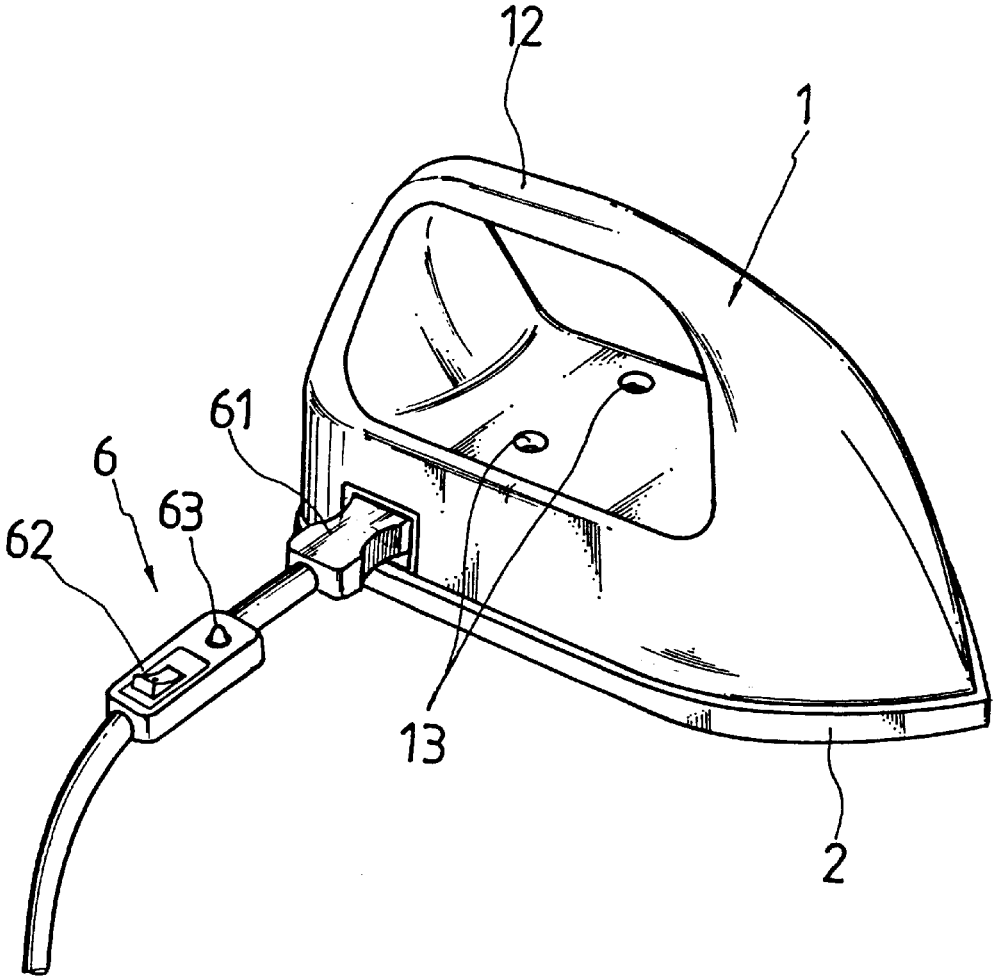
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
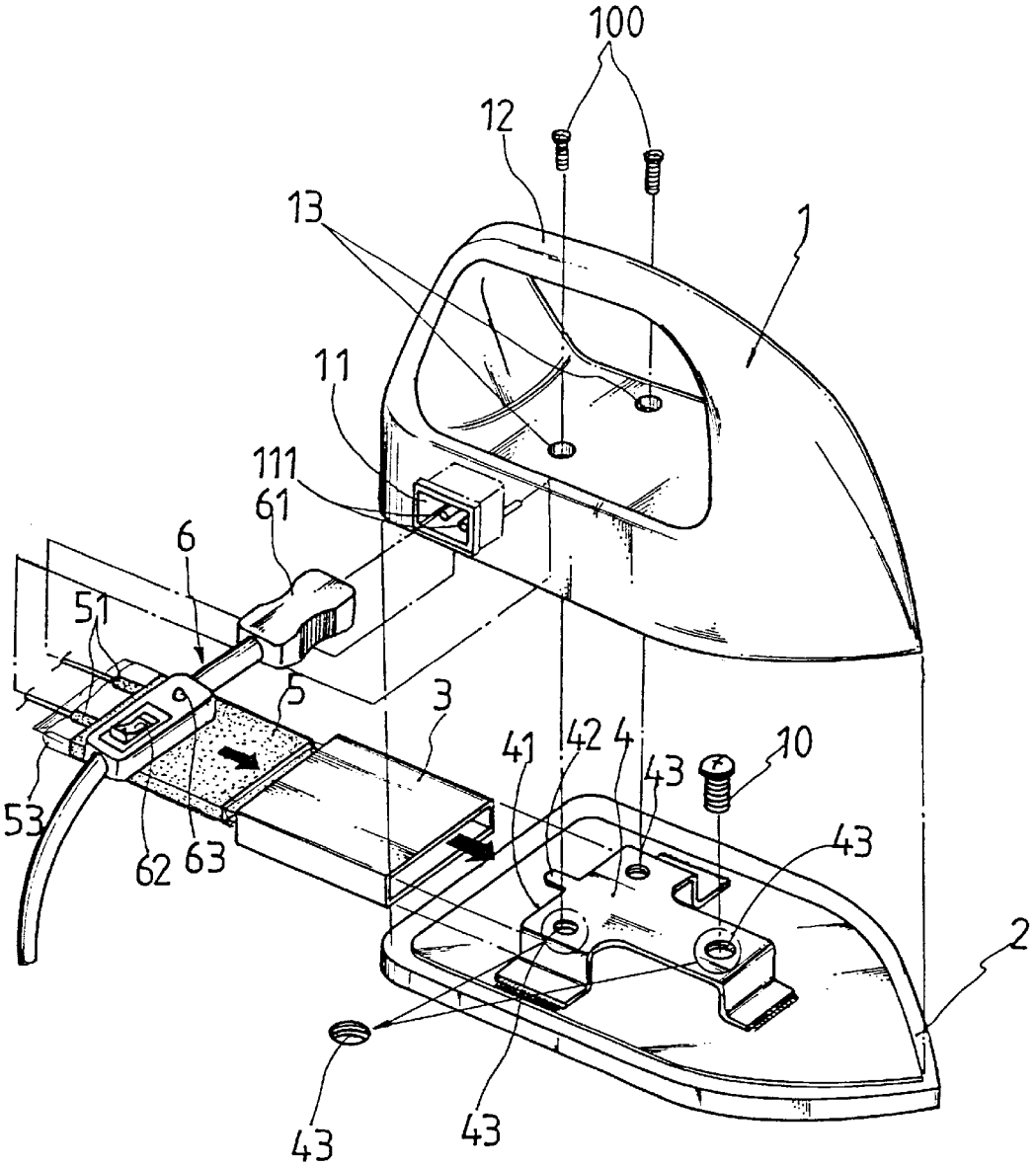
FIG. 2 is an exploded view of the present invention.

With reference to the drawings and in particular to FIGS. 1 and 2 thereof, the mini electric iron according to the present invention generally comprises a housing 1, a metal base 2, a protection sleeve 3, a T-shaped mounting 4, a ceramic heating member 5 and a detachable socket assembly 6.

The housing 1 is made of non-metallic material which is of low conductivity thereby preventing an user from being scalded. The lower portion of the housing 1 is provided with a receptacle 11 having two pins 111 adapted to engage with two terminals 51 of the ceramic heating member 5. In addition, the receptacle 11 is designed to receive the detachable socket assembly 6 which includes a plug 61 and a switch control member 62 arranged behind the plug 61 and provided with a power indicator 63. Further, the housing 1 is formed with two holes 13 for the passage of two screws 100.

The metal base 2 has a flat bottom for making clothes smooth. The T-shaped mounting 4 has three depending legs welded or otherwise secured to the upper side of the metal base 2 thus forming a space 41 between the T-shaped mounting 4 and the metal base 2. The T-shaped mounting 4 is provided with a lug 42 at the entrance of the space 41. The ceramic heating member 5 is fitted inside the sleeve 3. The sleeve 3 is inserted into the space 41 and then the lug 42 is bent down to keep the sleeve 3 in place thereby preventing the sleeve 3 and the ceramic heating member 5 from getting out of the T-shaped mounting 4.

Figure 3:
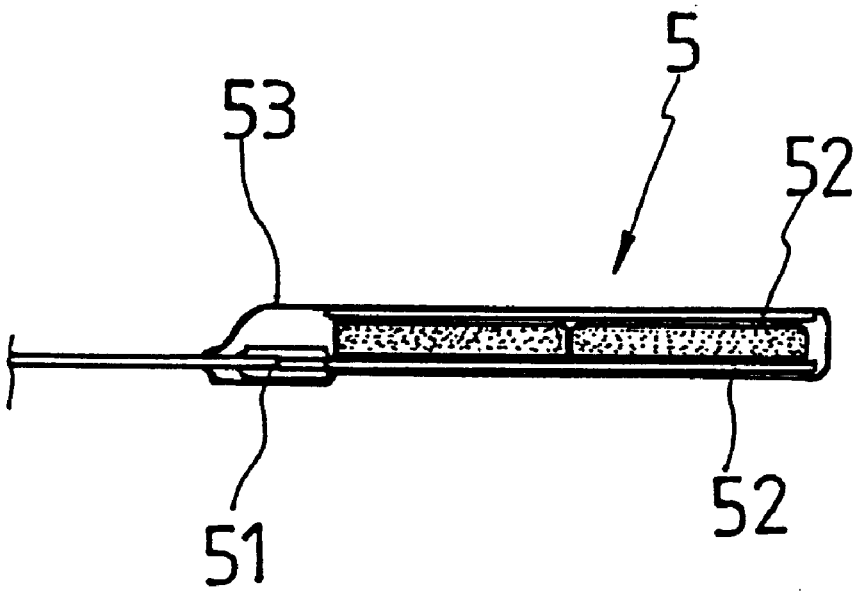
FIG. 3 is a sectional view of the ceramic heating member.

The sleeve 3 is a hollow rectangular member of high conductivity designed for protecting the ceramic heating member 5. The sleeve 3 is fitted inside the space 41 between the T-shaped mounting 4 and the metal base 2. Referring to FIG. 3, the ceramic heating member 5 is provided with two sheet 52 of metal one at the top and the other at the bottom and fitted within an insulating high temperature resistant enclosure 53.

Figure 4:
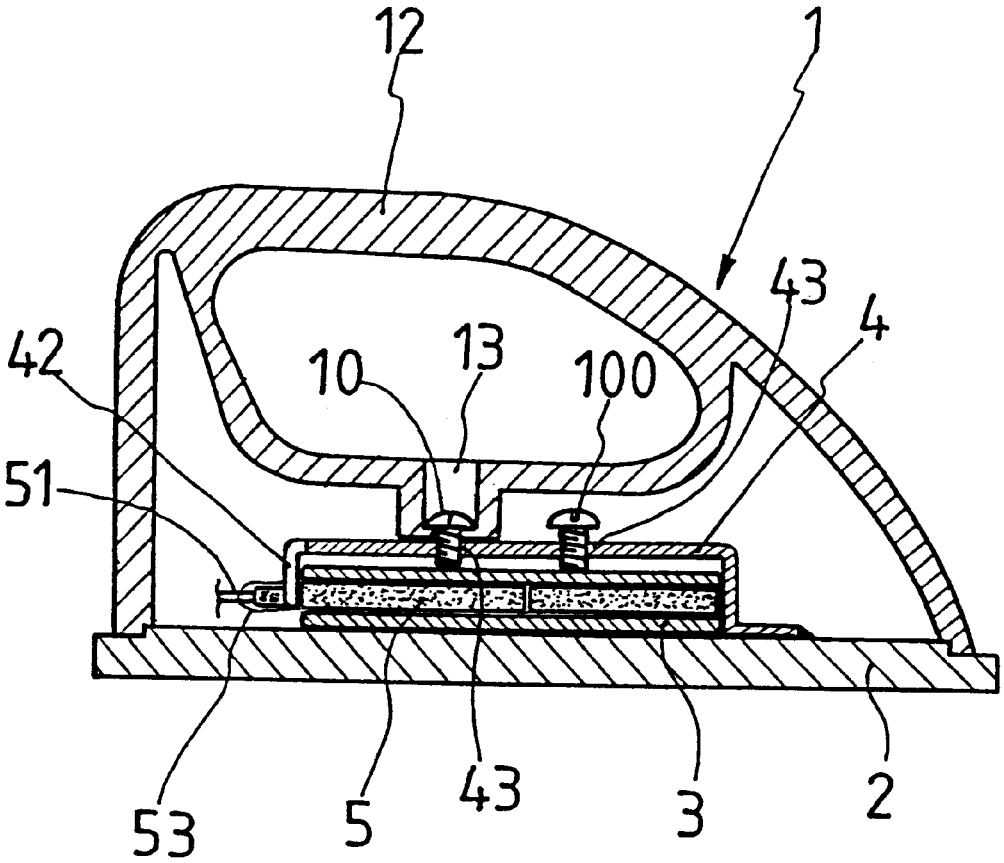
FIG. 4 is a sectional view of the present invention.

Referring to FIG. 4, when in assembly, the ceramic heating member 5 is fitted within the sleeve 3 which is in turn inserted into the space 41 between the T-shaped mounting 4 and the metal base 2. Then, the lug 42 of the T-shaped mounting 4 is bent down to keep the sleeve 3 and the ceramic member 5 within the space 41. The sleeve 3 is further fixed in place by a screw 10 extending through the threaded hole 43 of the T-shaped mounting 4. Two screws 100 extend through the two holes 13 of the housing 1 and two threaded holes 43 of the T-shaped mounting 4 to bear against the top of the sleeve 3 thereby engaging the housing 1 with the metal base 2.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A mini electric iron comprising:

a housing made of non-metallic material and having a lower portion provided with a receptacle and two openings;

a metal base having a flat bottom;

a T-shaped mounting having three depending legs secured to an upper side of said metal base thus forming a space between said T-shaped mounting and said metal base said T-shaped mounting being provided with a lug at an entrance of said space, said T-shaped mounting being formed with three threaded holes;

a sleeve fitted inside said space;

a ceramic heating member fitted inside said sleeve and electrically connected with said receptacle, said ceramic heating member being provided with a sheet of metal at a top and bottom thereof and inserted within an insulating high temperature resistant enclosure;

a first screw extending through one of said threaded holes to bear against a top of said sleeve;

two second screws extending said two openings and other two of said threaded holes to bear against said top of said sleeve; and a detachable electrical connector engageable with said socket.

* * * * *